US006079328A

United States Patent [19]

Beck

[11] Patent Number: 6,079,328

[45] Date of Patent: Jun. 27, 2000

[54] SECURING DEVICE FOR A PRINTED CARRIER

[75] Inventor: Peter Franz Beck, Karlstadt, Germany

[73] Assignee: Koenig & Bauer Aktiengesellschaft, Wurzburg, Germany

[21] Appl. No.: 09/269,740

[22] PCT Filed: Oct. 1, 1997

[86] PCT No.: PCT/DE97/02256

§ 371 Date: Apr. 6, 1999

§ 102(e) Date: Apr. 6, 1999

[87] PCT Pub. No.: WO98/16385

PCT Pub. Date: Apr. 23, 1998

[30] Foreign Application Priority Data

Oct. 11, 1996 [DE] Germany ..... 196 41 953

[51] Int. Cl.[7] ..... B65H 43/00; B41F 13/54

[52] U.S. Cl. ..... 101/219; 101/216; 226/11

[58] Field of Search ..... 101/224, 226, 101/219, 212, 216; 226/11

[56] References Cited

U.S. PATENT DOCUMENTS

| | | | |
|---|---|---|---|
| 5,036,765 | 8/1991 | Keilhau | 101/228 |
| 5,239,903 | 8/1993 | Rosas et al. | 83/456 |
| 5,619,923 | 4/1997 | Kotterer | 101/226 |
| 5,931,092 | 8/1999 | Werner et al. | 101/219 |

FOREIGN PATENT DOCUMENTS

| | | |
|---|---|---|
| 391246 | 10/1990 | European Pat. Off. . |
| 3911990 | 10/1990 | Germany . |
| 3929227A1 | 3/1991 | Germany . |
| 4124391A1 | 1/1993 | Germany . |

*Primary Examiner*—John S. Hilten
*Assistant Examiner*—Daniel J. Colilla
*Attorney, Agent, or Firm*—Jones, Tullar & Cooper, P.C.

[57] ABSTRACT

A securing device for a printed carrier in a printing press is actuated in case of the tearing of the printed carrier. The paper web or printed carrier can be clamped between an inflatable hose and a stationary counter clamping device. The hose has a non-operating position which is out of the path of web travel, and can be rapidly inflated to its operating position if a paper web break is sensed. An intermediate, partially inflated position can also be attained by the hose.

7 Claims, 1 Drawing Sheet

SECURING DEVICE FOR A PRINTED CARRIER

FIELD OF THE INVENTION

The present invention relates to an arresting or stopping device for a print carrier, such as a paper web.

DESCRIPTION OF THE PRIOR ART

A paper web separation and arresting device for the prevention of damage to print units or folding devices in case of paper web tears, is known from DE 39 29 2271 A1. This prior art device consists of a stationary, strip-shaped clamping elemen,t and of a strip-shaped clamping element which is arranged axis-parallel with the stationary element which and can be displaced in the direction toward the stationary clamping element. The running paper web is guided through the clamping elements, which are spaced apart from each other, during the production phase of the print unit. In case of a malfunction of the paper transport, a control command is triggered by a corresponding control device and actuates cylinder-piston units. These cylinder-piston units move the displaceable strip-shaped clamping element in the direction toward the stationary clamping element. In the process, the running paper web is stopped, so that coiling of the paper web, which could damage the press, is prevented.

SUMMARY OF THE INVENTION

The object of the invention is based on providing a switchable arresting device for a print carrier of printing presses.

In accordance with the present invention, this object is attained by providing a rubber-elastic hose and a counter-clamping device which are secured to the frame of a printing press. The rubber-elastic hose can be inflated to increase its cross-section thereby bringing it into clamping engagement with the counter-clamping device.

The advantages which can be achieved by the invention consist, in particular, in that a device for arresting a print carrier, made of paper or plastic, of paper or foil webs or sheets, has been created, which operates without sharp-edged or mechanically moved elements. The inflatable hose, which in case of a malfunction moves in the direction toward the paper web, and the cooperating stationary clamping strip, assure a rapid and dependable holding or clamping of the paper web, so that damage to the printing or folding units because of coiling or plugging is prevented. Particularly short actuating times are achieved with the device of the present invention because of the low mass inertia of the inflatable hose. The actuating time of the inflatable hose can be further reduced by preliminarily pre-inflating the hose with a defined partial inflation air pressure.

Finally, because of the few structural components and the absence of mechanical elements, such as work cylinders or the like, only little space is required when installing the device, for example in front of a print unit.

BRIEF DESCRIPTION OF THE DRAWINGS

A preferred embodiment of the present invention is represented in the drawing and will be described in greater detail in what follows.

Shown are in.

DESCRIPTION OF THE PREFERRED EMBODIMENT

Figure 2:
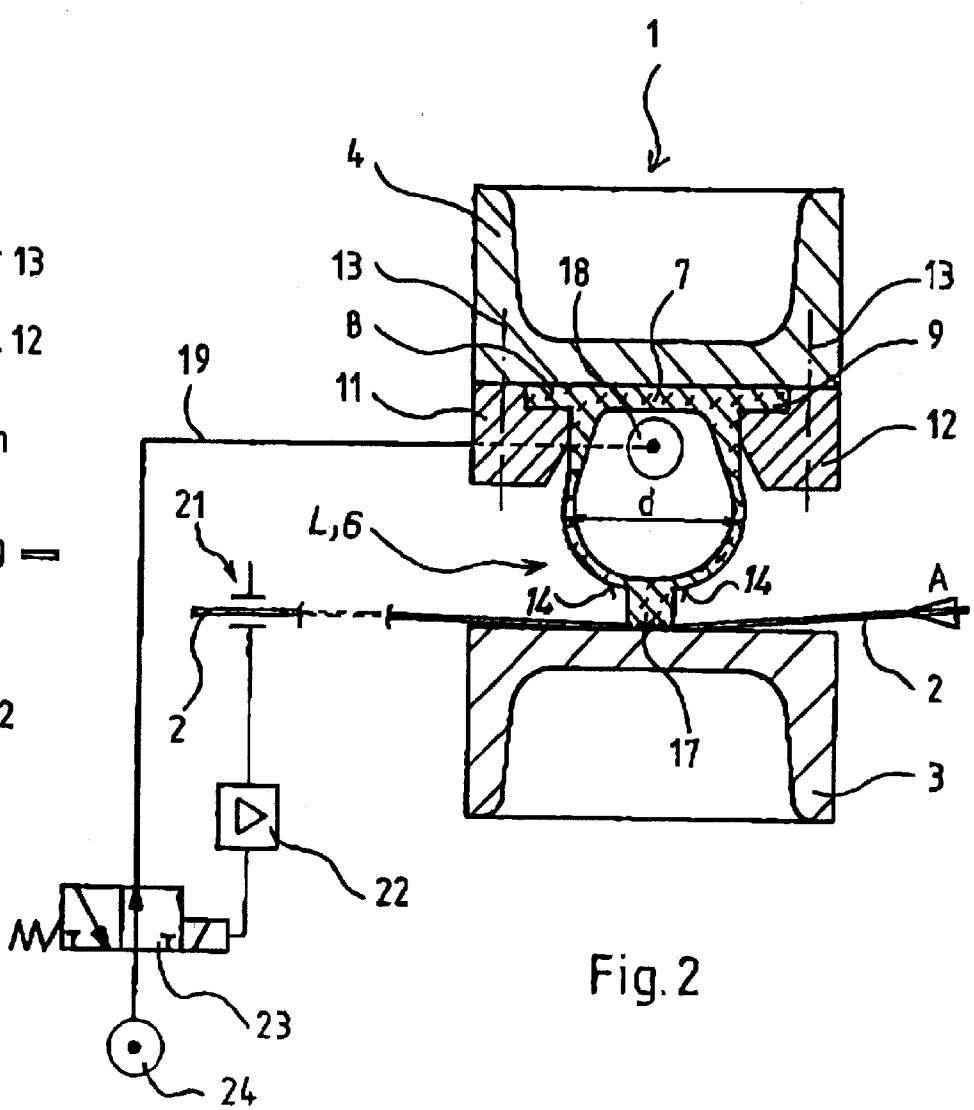
Figure 1:
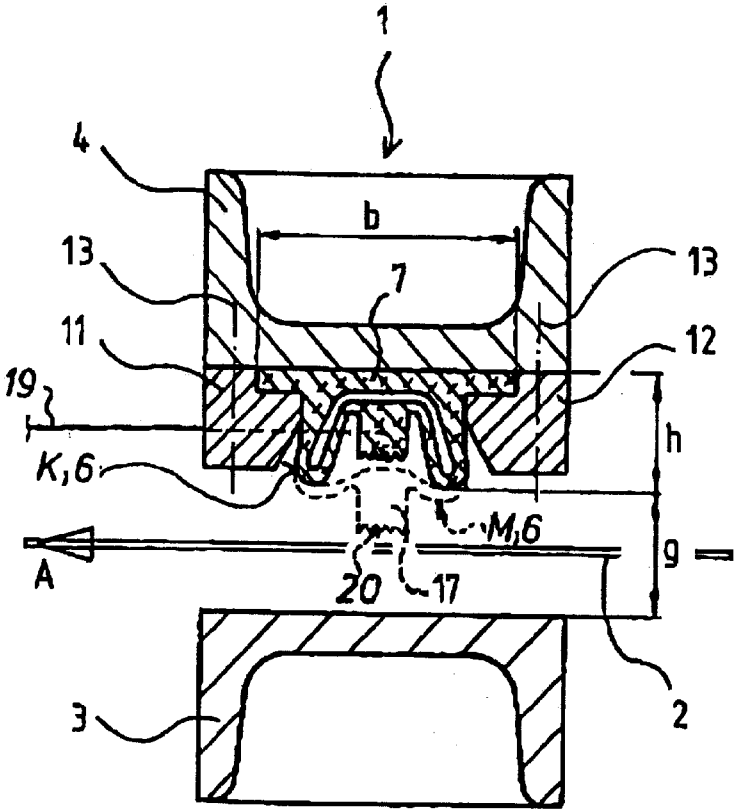
FIG. 1, a schematic representation of a cross section through an arresting device in a first, low operating position, as well as in an intermediate operating position; and in FIG. 2, a schematic representation of a cross section through an arresting device in a second, higher operating position, as well as an associated switching diagram.

An arresting device 1 for a print carrier web, for example a paper web 2, of a print carrier web moving through a rotary printing press, as seen in FIGS. 1 and 2, is located, for example, in front of the inlet of each print unit, or respectively in front of, or before the inlet of a folding device. The arresting device 1 consists of a stationary counter clamping device or clamping strip 3, for example in the form of a transverse bar, extending crosswise in respect to the running direction A of the paper web 2 between the two side frames, and positioned on a first side of the paper web 2. On the other or second side of the paper web 2, an identical transverse bar 4 is fastened between the side frames, and extends axis-parallel with this stationary clamping strip 3 and is mirror-reversed with respect to it, for example at a distance g, h, for example g=h=16 mm. The paper web 2 runs between the stationary clamping strip 3 and the transverse bar 4.

On its side facing the paper web 2, this transverse bar 4 has a clamping body, for example a rubber-elastic hose 6, which can be charged with a pressure medium. On its underside, or respectively its side facing the transverse bar 4, this hose 6 has a bottom or attachment strip 7, extending over the entire length of the hose 6 and fixed on it. A width b of the hose attachment strip 7 is greater than an exterior diameter of the hose 6. In this way, ends or flanges 8, 9 project out on both sides of the hose cross section, which flanges 8 and 9 are fastened to the transverse bar 4 by means of clamping rails 11, 12. The clamping rails 11, 12 can be fastened to the transverse bar 4 by means of screws 13, for example. A hose work surface 14 is formed on the side of the inflatable hose 6 opposite the bottom attachment strip 7, i.e. in the center of the unencumbered circumference of the hose 6. Hose work surface 14 and is provided with a friction-enhancing or slip-proof material. It can also consist of a profiled clamping strip 17 with a corrugated clamping face 20, as shown in dashed lines in FIG. 1 which is fixed on the hose and extends on the exterior circumference of hose b in the axis-parallel direction of the hose 6.

The hose 6 preferably consists of rubber with a textile insert, for example, and of the bottom attachment strip 7 which is made of rubber. Because of the arrangement of the textile insert, in a first, low inflation pressure, non operating position K, the hose 6 is in a state where its cross section is collapsed, and has a low height h, as is depicted in FIG. 1. In the non operating position K the hose 6 has a profile which corresponds to two letters U arranged inside each other.

The hose 6 is of a length which at least corresponds to the width of the paper web 2. A connector 18 for connecting a pipe line 19 for the pressure medium, which may be for example compressed air, is located on one of the two ends of the hose 6. The pressure medium can also be oil or a gel.

A web tear control device 21 for the paper web 2 is arranged in the running direction A of the paper web 2 and downstream of a print unit, or a folding device, both of which a not represented, and which detects an interference with the web transport, for example a web tear in the print units, or a missing specimen in the folding unit, all as seen in FIG. 2. The web tear control device 21 can be made up of, for example, tracers, photodiodes, sensors or the like. A signal emitted by the web tear control device 21, in case of a malfunction, is provided via an amplifier 22 to a magnet valve 23. The magnet valve 23 then makes a connection between the hose 6 and a central compressed air supply 24 provided at a pressure of six bar, for example. By means of this, the hose 6 is inflated in the shortest possible time, for example in a few milliseconds, so that its cross section is increased, because of being charged with the pressure medium, to a second, larger cross-section operating position L, i.e. the hose 6 is inflated.

The hose 6 has now been extended, upon inflation, in its radial direction, i.e. in the direction of the hose diameter d, by the amount g+h, so that the profiled clamping strip 17 of the hose 6 is pressed against the paper web 2 running between the clamping strip 3 and the hose 6 fastened on the transverse bar 4. This clamping action which results in the severing of the paper web 2. In this inflated operational condition the hose 6 has a cross-section which is a multiple of the cross section found in the former non-operational position of rest, so that an operating position L, which is distant from the first non operating position K, is created. A known catching roller, which is located in the production direction, for example respectively downstream of the print unit, then rolls up the severed paper web. At the termination of the compressed air charge, the hose 6 is returned into its position of rest because of its inherent restoring force.

In another embodiment, the restoration can also take place by means of suction air instead of an impressed restoring force.

It is also possible to fasten the attachment or bottom strip 7 of the hose 6 to the transverse bar 4 in another way, for example by gluing.

Damage to the print unit, for example by coiled paper web, is prevented by the present invention.

It is furthermore possible to provide one or several connectors 18 for the pipe line 19 on both ends of the hose 6 or on the side of the hose 6.

It is also advantageous to coat the stationary clamping strip 3, on its side facing the paper web 2, with a slip-resistant material, for example rubber. The material must have a high coefficient of friction in relation to paper or foil.

Finally, it is also possible to provide the stationary clamping strip 3, on its side facing the paper web 2, also with a hose 6 which, in its operating position parallel with the hose 6 on the transverse strip 4, can also be filled with air.

It is also possible for the hose 6 to have the cross section of a shallow oval in its low or non operating position K.

A further preferred embodiment variant consists in prestressing the hose 6 in its first, low non operating position K by means of compressed air of, for example 0.2 to 0.5 bar, so that in case of a failure of the paper web 2 the second, higher operating stage of hose 6 is attained even faster. To this end, a second pressure-adjustable check valve, not represented, is connected parallel with the magnet valve 23 which is shown in FIG. 2. Prestressing of the hose 6 in the non operating position K can be just strong enough so that its elastic shape in the state of rest is not changed so that it stays in the shape shown in FIG. 1.

It is also possible to preset the hose 6 by means of charging it with a pressure medium into an intermediate, pressure medium-prestressed operating position M depicted in FIG. 1 which is located between the first non operating position K and the second operating position L at any arbitrary height h+g/x. In this case, x is a natural number, for example between one and ten. While a preferred embodiment of a securing device for a printed carrier in accordance with the present invention has been set forth fully and completely hereinabove, it will be apparent to one of skill in the art that a number of changes in, for example the type of printing press or folding device being used, the width of the printed carrier and the like may be made without departing from the true spirit and scope of the present invention which is accordingly to be limited only by the following claims.

What is claimed is:

1. A device for arresting a print carrier comprising:

a hose, said hose having a small cross-section non-operating position, and an increased cross-section operating position;

a counter clamping device spaced from said hose and cooperating with said hose to define an opening through which a print carrier can travel; and means for charging said hose with a pressure medium and bringing said hose into said operating position.

2. The device of claim 1 further including means for returning said hose to said non-operating position.

3. The device of claim 1 further including providing said hose with an intermediate operating position having a cross-section greater than said non-operating position and less than said operating position.

4. The device of claim 1 wherein said operating cross-section of said hose is a multiple of said non-operating cross-section of said hose.

5. The device of claim 1 further including a working surface of said hose engageable with said counter-clamping device, and friction increasing means on said working surface.

6. The device of claim 5 wherein said working surface is a profiled strip extending in an axial direction of said hose and further wherein said friction increasing means is a corrugated clamping face on said profiled strip.

7. The device of claim 1 further including a transverse bar, and means securing said hose to said transverse bar.

* * * * *